US006129768A

United States Patent [19]

Johnson et al.

[11] Patent Number: 6,129,768

[45] Date of Patent: Oct. 10, 2000

[54] METHOD AND APPARATUS FOR OPERATING AN AUTOMATIC BALANCING SYSTEM

[75] Inventors: Troy A. Johnson; John E. Thomas, both of Newton, Iowa

[73] Assignee: Maytag Corporation, Newton, Iowa

[21] Appl. No.: 09/187,143

[22] Filed: Nov. 6, 1998

[51] Int. Cl.[7] ..... D06F 37/22

[52] U.S. Cl. ..... 8/159; 68/23.1; 68/23.2

[58] Field of Search ..... 68/23.1, 23.2, 68/23.5, 23.3; 8/159; 74/573 F

[56] References Cited

U.S. PATENT DOCUMENTS

| | | |
|---|---|---|
| 2,683,535 | 7/1954 | Smith . |
| 2,836,083 | 5/1958 | Smith . |
| 2,888,979 | 5/1959 | Baxter . |
| 2,964,192 | 12/1960 | Brown . |
| 2,984,094 | 5/1961 | Belaieff . |
| 3,066,522 | 12/1962 | Steinmuller . |
| 3,330,168 | 7/1967 | Kahn . |
| 3,446,043 | 5/1969 | Severance . |
| 4,991,247 | 2/1991 | Castwall et al. . |
| 5,806,349 | 9/1998 | Kim et al. . |
| 5,855,127 | 1/1999 | Kohara et al. . |
| 5,862,553 | 1/1999 | Haberl et al. . |

FOREIGN PATENT DOCUMENTS

| | | |
|---|---|---|
| 52-23871 | 2/1977 | Japan . |
| 52-62977 | 5/1977 | Japan . |
| 60-18440 | 5/1985 | Japan . |
| 2080836 | 2/1982 | United Kingdom . |
| 2138029 | 10/1984 | United Kingdom . |

*Primary Examiner*—Frankie L. Stinson
*Attorney, Agent, or Firm*—Zarley, McKee, Thomte, Voorhees & Sease

[57] ABSTRACT

According to a method and apparatus for balancing a container using a closed system fluid balance ring for high rotational speed washing machines, the transfer of fluid is pulsed, allowing for a variable overall mass transfer rate while computation of the imbalance continues. Mass transfer continues until any significant imbalance is eliminated. The quasi-constant nature of this method allows for the resulting imbalance tolerances to be significantly lower. As the imbalance decreases, the mass transfer rate is varied accordingly.

12 Claims, 3 Drawing Sheets

METHOD AND APPARATUS FOR OPERATING AN AUTOMATIC BALANCING SYSTEM

BACKGROUND OF THE INVENTION

In conventional clothes washing machines, either front loading or top loading, the spinner is rotatably mounted within the cabinet. A balancing system can be provided in the machine so as to counteract uneven or unbalanced loads in the spinner during the spin cycle. In the spin cycle, an exact balancing never actually takes place with respect to the axis of rotation of the rotating container. A radial force develops from this imbalance generating a moment about the bearings. The vector direction of this moment rotates with the spinner. This rotating force and moment cause oscillations and vibrations which must be substantially eliminated.

These oscillations and vibrations have been eliminated to some degree by active balancing systems which are continuous duty cycles for a pump valve combination that moves mass while a mass placement algorithm calculates the new unbalance. After this new unbalance is calculated, more mass is transferred resulting in a smaller unbalance. This process continues until the degree of unbalance is within a specified tolerance. Invariably, the serial process of computation and then mass transfer consumes a substantial amount of time. As the speed of the rotating unbalance increases, the magnitude of the required counterbalance mass decreases. Eventually, the magnitude of the required counterbalance mass approaches the resolution of the mass transfer devices.

It is therefore the principal objective of this invention to remedy the drawbacks indicated and to provide a method by which the tolerances and the time required to achieve those tolerances are reduced.

Another objective of the present invention is the provision of an improved method for balancing the spinner of a washing machine.

Another objective of the present invention is the provision of an improved washing machine wherein the balance system is such that the washing machine is virtually free from oscillations and vibrations caused by an unbalanced load.

These and other objectives will become apparent from the following description of the invention.

SUMMARY OF THE INVENTION

The present invention is directed towards a method and apparatus for balancing an uneven load in a rotating spinner. The objectives of the present invention are accomplished by transferring fluid in a fluid balance ring when the load in the spinner becomes uneven. This transfer preferably takes place by constantly pulsing the input of fluid. While this pulsing is continuing, the amount of imbalance is constantly being determined so as to properly limit the input rate of the fluid.

DETAILED DESCRIPTION OF THE PREFERRED EMBODIMENT

Figures 1, 2:
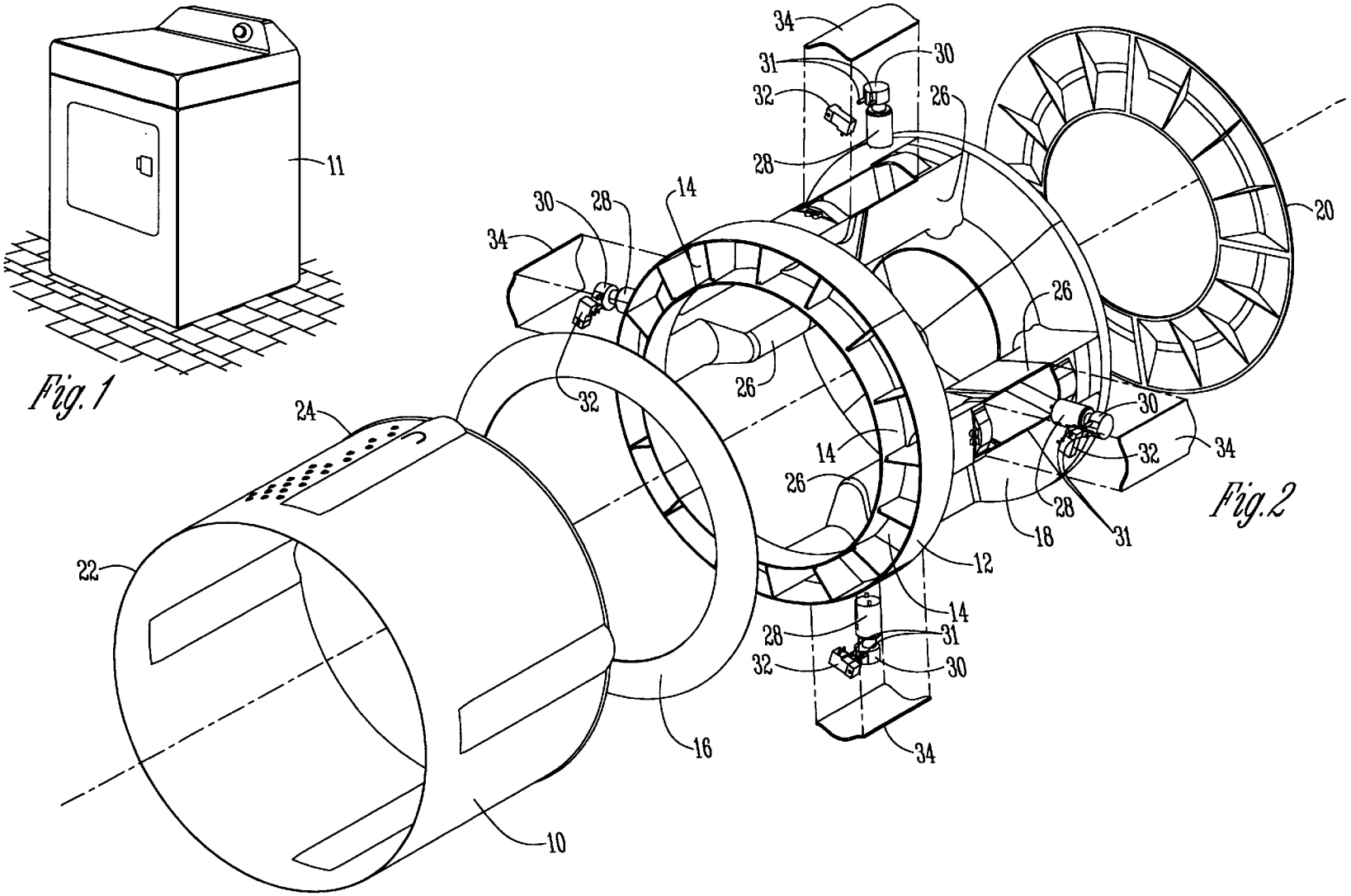
FIG. 1 is a pictorial view of a washing machine incorporating the present invention.
FIG. 2 is a front isometric exploded view of the washing machine spinner and fluid balance ring assembly of the present invention.
Figures 3, 7:
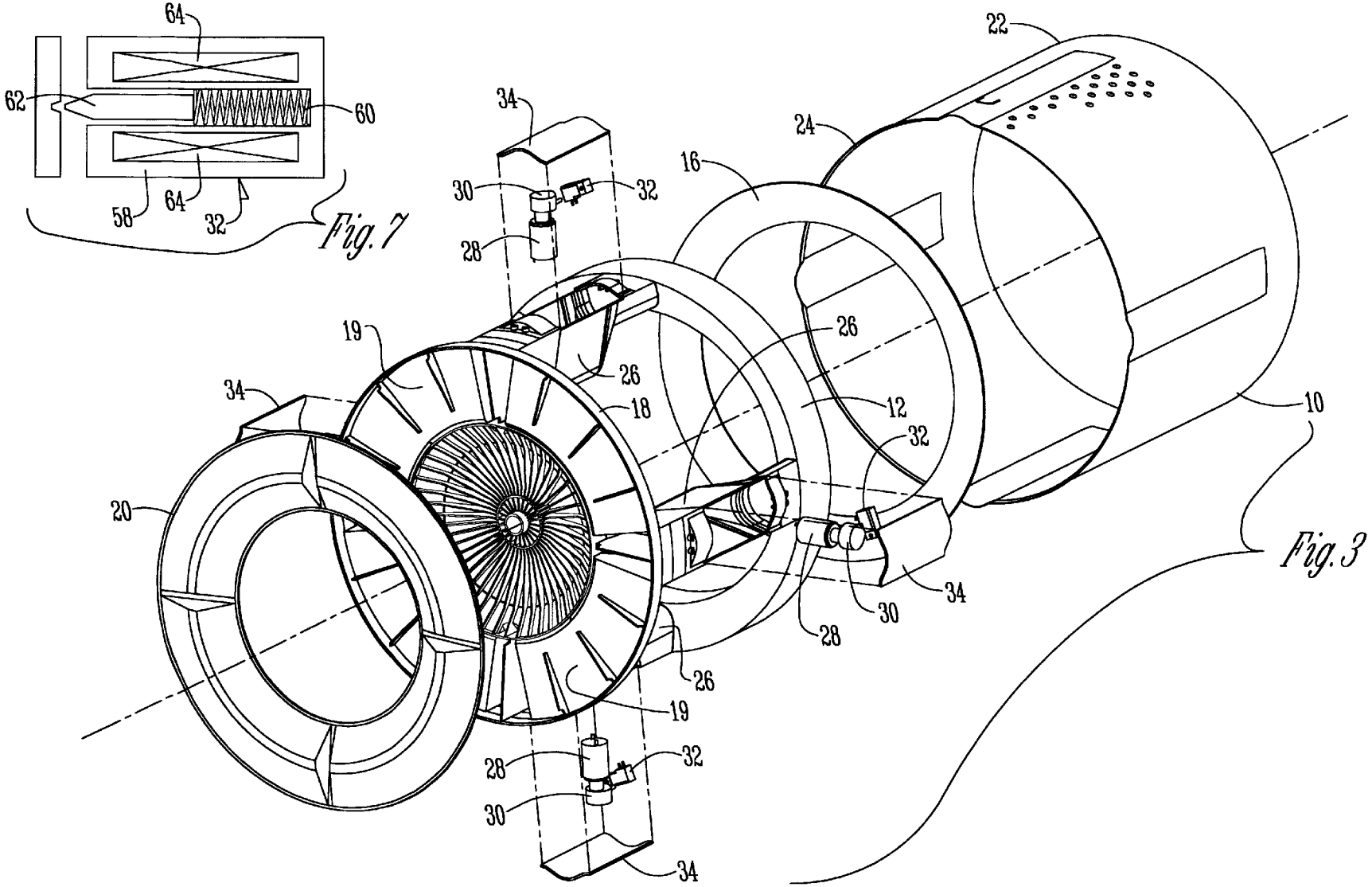
FIG. 3 is a rear isometric exploded view of the spinner and fluid balance ring assembly of FIG. 2.
FIG. 7 is a schematic view of a valve.

A horizontal axis clothes washing machine includes a spinner 10 rotatably mounted within a cabinet 11. It is also assumed that the spinner 10 has been loaded with laundry and that an automatic wash program, which includes the necessary imbalance detection and calculation algorithms, has been selected. FIGS. 2 and 3 illustrate the basic construction of the spinner 10 with the closed system fluid balance ring.

More particularly, the spinner 10 includes a fluid balance ring assembly. The assembly includes a front ring 12 having a plurality of compartments 14 therein which are closed by a cover 16. A similar back ring 18 has a plurality of compartments 19 which are closed by a back cover 20. The front ring 12 is positioned adjacent the open front end 22 of the spinner 10, while the back ring 18 is positioned adjacent the back end 24 of the spinner 10.

A plurality of baffles 26 extend between the front ring 12 and the back ring 18 on the inner surface of the side wall of spinner 10. The baffles 26 function to lift and tumble clothing within the spinner 10 during the wash cycle of the machine. The baffles 26 also define a housing for the motor 28, pump 30 and solenoid valve 32 which control the transfer of fluid within the compartments 14 and 19 of the rings 12, 18. A cover 34 is provided for each baffle 26 so as to seal the baffle housing against water leakage. The basic structure of the fluid rings 12, 18 covers 16, 20 baffles 26, and baffle covers 34 is conventional. The motors 28, pumps 30, and solenoid valves 32 are also conventional, along with their electrical and fluid connections.

Figure 5:
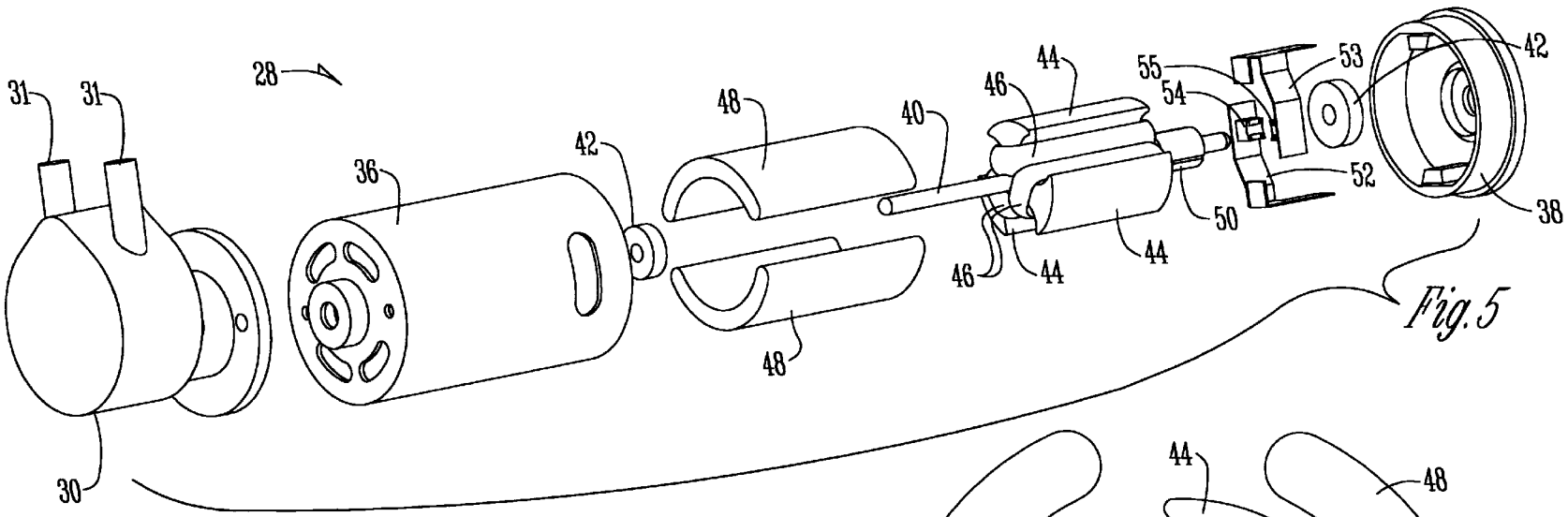
FIG. 5 is an exploded view of the pump and motor.
Figure 6:
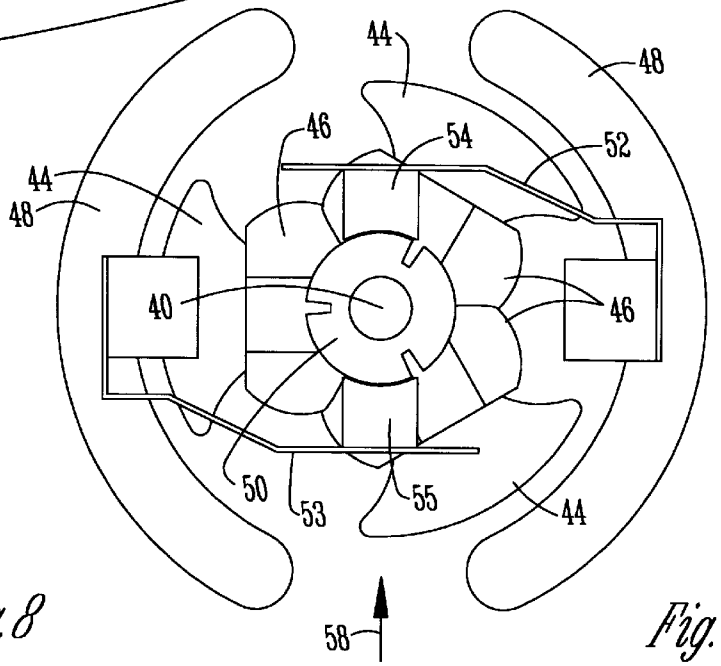
FIG. 6 is an enlarged end view of the motor, with the bottom cap and housing removed.
Figure 8:
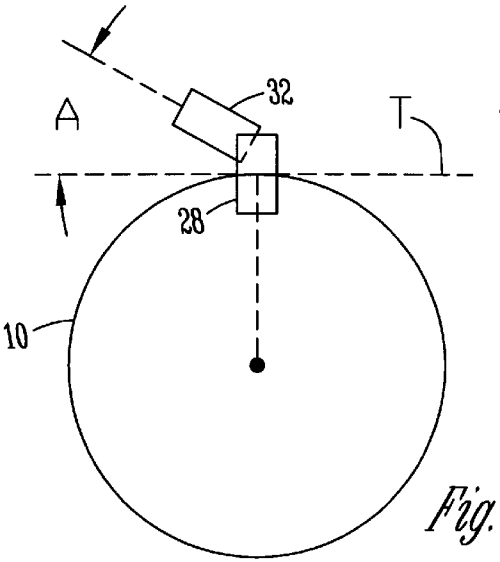
FIG. 8 is a schematic view showing the orientation of the motor and valve.
Figure 4:
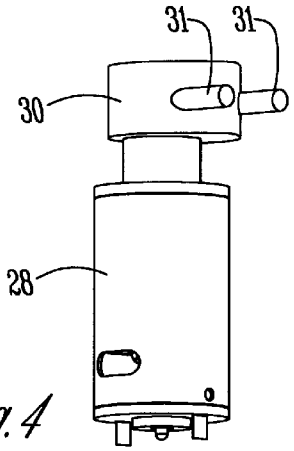
FIG. 4 is an isometric view of a pump and motor of the fluid balance ring.

As best seen in FIG. 5, each motor 28 includes a housing 36 and an end cap 38. A shaft 40 is journaled within the housing 36 and end cap 38 and is rotationally supported by bearings or bushings 42. Mounted on the shaft 40 is a laminated stack 44 with electrical coils or windings 46 wound around the stack 44 and the commutator 50. A pair of permanent magnets 48 extend substantially around the stack 44 within the housing 36. Commutator 50 is provided on one end of the shaft 40. A pair of spring biased arms 52, 53 each have an electrical contact 54, 55 mounted thereon which are adapted to normally contact the commutator 50, as shown in FIG. 6. Power is supplied to the motor through electrical contacts 54, 55. The arms 52, 53 spring load the electrical contacts 54, 55 against the commutator 50. This supplies current to the coils 46 which generates the torque to rotate the shaft 40.

FIG. 7 shows the valve 32, which includes a housing 58 with a spring 60 holding the armature 62 in the closed position and the coil 64 which when energized overcomes the spring force and opens the valve 32.

In a most preferred embodiment, laundry is placed in the spinner 10, and after a complete wash and rinse cycle, the spinner 10 begins to rotate at high speeds, up to 1,600 rpm. The laundry is potentially unevenly distributed, creating an imbalance in the rotating spinner 10. This imbalance is detected in the usual way by force sensors and accelerometers (not shown) and is converted into data which is sent to a microcontroller (not shown). The data is then analyzed by the microcontroller using the imbalance algorithm which determines the amount and location of mass needed to eliminate the imbalance.

The transfer of the proper amount of mass to a proper location within the fluid balance ring is accomplished through the use of the motors 28, pumps 30 and valves 32. Fluid is moved from one of the compartments 14 or 19 to another within the fluid balance ring. Pump nozzles 31 extend into rings 12 or 18. A pump 30 is connected to two compartments in a ring 12 or 18 and can transfer fluid in both directions between compartments depending on the required position of the unbalance mass. The fluid is removed from one compartment and pumped to another by pumps 30. The transfer is started and then monitored by sensors and the microcontroller. When the unbalance is below predetermined thresholds, pumping is stopped. This step is repeated each time the thresholds are exceeded, such as by shifting of the unbalance, extraction of water from the clothes or because of a speed change which changes the magnitude of the centrifugal forces. Varying the flow rate in this manner allows this type of continuous process of fluid transfer in steps where the magnitude of the unbalance is small. This continuous method is less time consuming than the discrete method of detecting the unbalance, computing a mass transfer, transferring the mass and measuring the results.

The motor 28 is constantly pulsed by supplying power to the motor 28 such that the voltage input, when measured, exhibits a square wave pattern. The value of the square wave at its positive amplitude is such that the voltage turns the motor 28 on. The value of the square wave at its negative amplitude is such that it turns the motor 28 off. The flow rate of the pump 30 is controlled by varying the frequency, period, or duty cycle, where duty cycle is defined as the percent of time the voltage is high enough to rotate the motor 28. If full voltage is supplied to the pump motor 28, the flow rate of the pump 30 is too high to transfer the required small amount of mass. By varying the input voltage duty cycle, the motor 28 will be slowed thereby transferring fluid with more precision. Adjustment of the frequency or period is performed by the microcontroller. By constantly performing calculations and constantly running the motor 28 through the use of the square wave voltage input, mass transfer continues until the oscillations and vibrations are substantially eliminated. Further, the allowable or tolerance levels can be much smaller.

Whereas the invention has been shown and described in connection with the preferred embodiments thereof, it will be understood that many modifications, substitutions, and additions may be made which are within the intended broad scope of the following claims. From the foregoing, it can be seen that the present invention accomplishes at least all of the stated objectives.

What is claimed is:

1. A method of balancing an uneven load in a rotating spinner having a fluid balance ring, the method comprising:

sensing the rotational imbalance of the spinner;

determining the amount of the rotational imbalance;

redistributing mass by pumping fluid to new locations in the fluid balance ring to counteract the uneven load in the spinner; and pulsing the pumping of the fluid in the fluid balance ring.

2. The method of claim 1 wherein the pulsing of the fluid has a pulsing period that may be varied to adjust the rate of fluid transferred in the fluid balance ring.

3. The method of claim 1 wherein the pulsing of the fluid has a pulsing duty cycle that may be varied to adjust the rate of fluid transferred in the fluid balance ring.

4. The method of claim 1 wherein a pump and motor assembly is used for pumping the fluid.

5. The method of claim 4 further comprising the step of supplying the motor with varying voltage to adjust the rate of fluid transferred in the fluid balance ring.

6. The method of claim 1 wherein a valve is operatively connected to the pump and motor assembly and is used for pulsing the pumping of fluid.

7. The method of claim 6 wherein the pump and motor assembly are mounted to the spinner.

8. A washing machine, comprising:

a cabinet;

a spinner mounted in the cabinet for rotation about an axis;

a fluid balance ring on the spinner and having a plurality of compartments; and apparatus for transferring fluid to the fluid balance ring by pulsated the pumping of the fluid.

9. The washing machine of claim 8 wherein the fluid is selectively transferred to any one of the compartments in the balance ring.

10. The washing machine of claim 8 wherein the apparatus for transferring fluid comprises:

a motor mounted in the spinner; and a pump connected to the motor for pumping fluid between the compartments in the balance ring.

11. The washing machine of claim 10 wherein the apparatus for transferring fluid further comprises a valve operatively connected to the pump and motor assembly.

12. In a method of balancing a spinner of a washing machine using a fluid balance ring having a plurality of separate compartments, the method including the steps of sensing for a rotational imbalance of the spinner, pumping a fluid into at least one of the compartments of the fluid balance ring to counteract the rotational imbalance, and continuing to sense for rotational imbalance and pump fluid into the fluid balance ring until a desired state of balance is reached, the improvement comprising:

transferring the fluid into the fluid balance ring by pulsing the pumping of the fluid.

* * * * *